United States Patent [19]

Ubel

[11] 4,108,404

[45] Aug. 22, 1978

[54] ARRANGEMENT FOR PROTECTING DATA COMMUNICATION IN A CONTINUOUS AUTOMATIC TRAIN CONTROL SYSTEM

[75] Inventor: Helmut Ubel, Stuttgart, Germany

[73] Assignee: International Standard Electric Corporation, New York, N.Y.

[21] Appl. No.: 781,827

[22] Filed: Mar. 28, 1977

[30] Foreign Application Priority Data

May 19, 1976 [DE] Fed. Rep. of Germany ..... 2622270

[51] Int. Cl.[2] ..... B61L 21/08

[52] U.S. Cl. ..... 246/34 CT; 324/58 A; 333/17 M; 333/32

[58] Field of Search ..... 246/34 R, 34 CT, 187 B, 246/28 C; 333/32, 17 M; 325/51, 54, 174; 324/58 R, 58 A, 58.5 R, 58.5 A; 328/162, 165

[56] References Cited

U.S. PATENT DOCUMENTS

| | | | |
|---|---|---|---|
| 3,249,863 | 5/1966 | Wright | 324/58 R |
| 3,532,982 | 10/1970 | Zeidlhack | 333/32 |

FOREIGN PATENT DOCUMENTS

| | | | |
|---|---|---|---|
| 1,530,427 | 4/1970 | Fed. Rep. of Germany | 246/34 CT |

*Primary Examiner*—Trygve M. Blix
*Assistant Examiner*—Reinhard J. Eisenzopf
*Attorney, Agent, or Firm*—John T. O'Halloran; Jeffrey P. Morris

[57] ABSTRACT

A system for protecting data communication against disturbances caused by unsymmetrical standing waves along track conductors wherein automatically controlled terminating resistors are utilized to prevent the formation of standing waves either totally or nearly totally. Baluns may be utilized to cause such standing waves to be automatically balanced. The sensitivity of continuous automatic train control to atmospheric influences and conductor asymmetries is eliminated in accordance with the invention.

15 Claims, 5 Drawing Figures

ARRANGEMENT FOR PROTECTING DATA COMMUNICATION IN A CONTINUOUS AUTOMATIC TRAIN CONTROL SYSTEM

BACKGROUND OF THE INVENTION

1. Field of the Invention

The present invention relates to an arrangement for protecting data communication between vehicles and track conductor loops in a continuous automatic train control system.

2. Description of the Prior Art

For track conductor loops, a standards committee has recommended the following systems of laying:

The system of laying referred to as $B_2$ consists of: conductors transposed at regular intervals and both running approximately in the middle between the rails.

The system of laying referred to as $B_3$ consists of: conductors transposed at regular intervals one of which runs in the middle between the rails, while the other is laid along the rail between flange and web.

In both of the aforementioned systems of laying, the conductors and the rail form a three-conductor system in which characteristic impedances ZL (conductor-conductor) and $ZE_1$, $ZE_2$ (conductor-rail) are effective. ZE is generally considerably smaller than ZL.

To achieve undisturbed wave propagation along a track conductor loop, which can be regarded as a twin line, it is common practice to use a balanced termination of the twin line as described in German Auslegeschrift (DT-AS) 2,219,644 and in the appertaining addition, German Offenlegungsschrift (DT-OS) 2,304,733. This balanced termination consists of two series-connected component resistances whose junction is connected to rail potential directly or via a capacitance.

This simple termination considerably improves the balance of the level and phase characteristics along a track conductor loop, but is not capable of matching to the characteristic impedance, which varies with weather conditions. Especially under wet or snow conditions, standing waves thus form along the track conductor loop due to mismatching of the component resistances; if the two component resistances are mismatched differently, these standing waves occur unbalanced, i.e., they differ in phase on the two conductors. In practice, this unbalance occurs very frequently and is due to inhomogeneities of the conductors as are unavoidable at switches, for example. At the transpositions of the track conductor loops, it results in abrupt level changes and in phase shifts of the received signal different from 180° which may cause errors in the information transmission and in the determination of train location.

SUMMARY OF THE INVENTION

The invention provides a system which prevents the abovementioned abrupt level changes and phase shifts different from 180 degrees and thus protects the data communication and the determination of train location from such disturbances.

The invention is characterized in that either the track conductor loops or the two conductors of the track conductor loops are terminated by automatically controlled resistors whose closed-loop control systems use as command variables the current or potential difference existing between two points of a conductor as a result of the occurrence of a standing wave. Thus the terminating resistors of the track conductor loops or of the conductors are continuously matched to the instantaneous characteristic impedance, which prevents the formation of standing waves.

The invention further is characterized in that the closed-loop control systems and the devices needed to adjust the resistors are fed with direct current which is so supplied over both conductors that the conductors are loaded uniformly, that the rails are used for the return of current, that high-inductance chokes are used to feed in and extract the direct current at the beginning and at the end of the track conductor loops, and that the direct current flowing through the conductors also serves to supervise the conductors for breaks. This eliminates the need for a costly trackside supply connection for the automatically controlled resistors. In addition, the current supplied to the resistors is used to supervise the conductors for breaks. The fact that the current is evenly divided between the two conductors ensures that the data communication is not disturbed at the transpositions of the loops by magnetic field variations caused by the direct current.

Another aspect of the invention is that for each conductor there is provided an electromechanically adjustable terminating resistor, that the control is performed with a differential amplifier followed by threshold switches which cause the value of the terminating resistor to be increased or decreased when the output voltage of the differential amplifier exceeds or falls below a predetermined voltage range, and that a voltage proportional to the voltage caused by a standing wave between two points of a conductor located a certain distance apart is applied to the inputs of the differential amplifier, the two points preferably being chosen so that the voltage caused by the standing wave is as high as possible there.

A further aspect of the invention is that, instead of an adjustable terminating resistor, several fixed resistors may be used, that, by connecting several resistors in parallel or series, the effective terminating resistance is automatically adjusted to the value coming closest to the characteristic impedance, and that, with a termination consisting of one or more fixed terminating resistors, standing waves still occurring on the two conductors of a track conductor loop to a small degree are automatically balanced by inductive elements which are preferably arranged at those points of the track conductor loops where the electrical variable used for balancing, i.e. the voltage or current of the standing wave, has a maximum value or difference between the conductors.

Here the mechanical adjustment of the terminating resistor, which requires regular maintenance, is replaced by maintenance-free switching of fixed resistors, which can be done by relay contacts, for example, and the standing waves still occurring to a small degree as a result of inevitably less accurate matching are balanced automatically.

Other and further advantages of the invention will become apparent with reference to the accompanying drawings and detailed descriptions thereof, wherein:

DESCRIPTION OF THE PREFERRED EMBODIMENT

Figure 1:
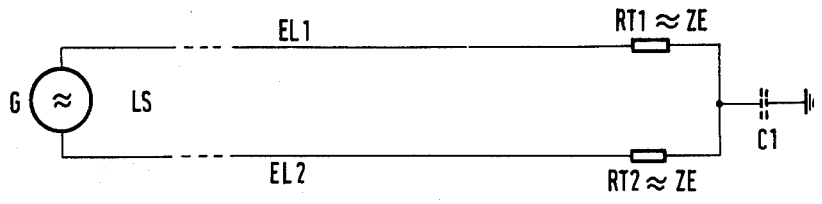
PRIOR ART Fig.1
FIG. 1 shows a prior art type track conductor termination.

FIG. 1 shows the prior art type termination of a track conductor loop LS: Two component resistances RT1, RT2 each about equal in value to the mean characteristic impedance ZE of a conductor with respect to ground connect the ends of the conductors EL to rail potential, which is equal to ground potential. If conductor-break supervision with direct current is provided for, the two component resistances RT1, RT2 are grounded via a capacitance C1.

Figure 2:
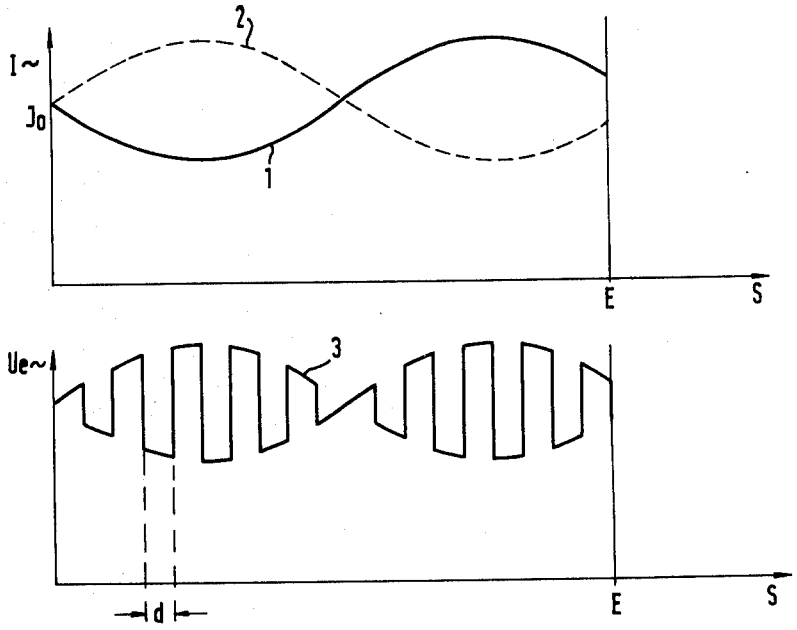
FIG. 2 shows the current distributions along conductors and the curve of the received voltage at the occurrence of antiphase standing waves.

FIG. 2 shows the current distributions I~ along such a track conductor loop LS if the terminating resistances are mismatched. The current amplitude along the conductors EL varies locally in the form of a standing wave superimposed on the value Io occurring with a perfect termination. The point E on the abscissa marks the end of the loop. Curve 1 belongs to a terminating resistance whose value is higher than the characteristic impedance ZE; curve 2 belongs to a terminating resistance which is lower than the characteristic impedance ZE. Curve 3 shows the shape of the received voltage Ue~ and the abrupt level changes occurring in the illustrated, particularly critical case of antiphase standing waves during the passage of a vehicle over the track conductor loop. The distance corresponds to the distance between the transpositions of the track conductor loop.

Figure 3:
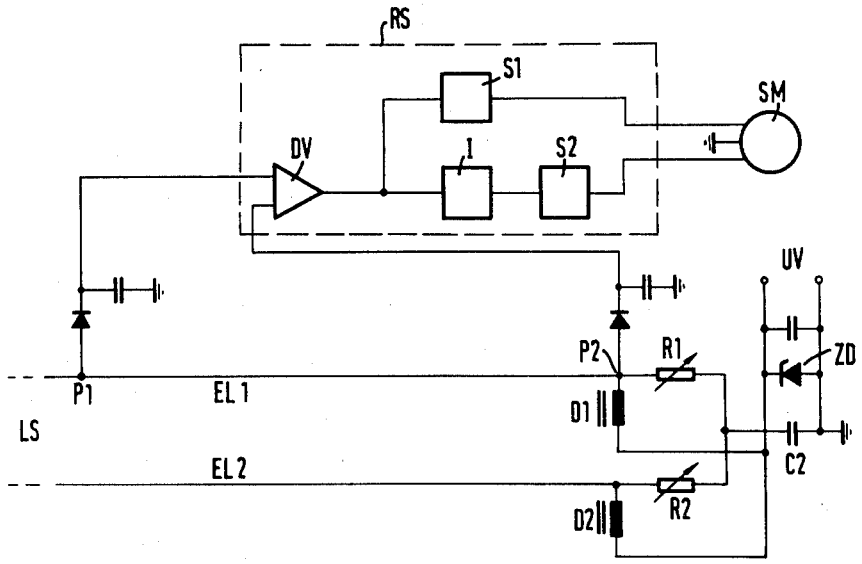
FIG. 3 shows a circuit with controlled terminating resistors.

FIG. 3 shows an embodiment of the arrangement according to the invention: The conductors EL1, EL2 of the track conductor loop LS are terminated in two variable resistors R1 and R2 connected together at one end and, via a capacitor C2, to rail potential. The dc supply voltage UV for the closed-loop system RS and for the servomotor SM of each conductor EL1, EL2 (in the drawing the closed-loop system RS and the servomotor SM are shown for one conductor only) is extracted immediately in front of the terminating resistors R1, R2 via chokes D1, D2. A zener diode ZD with a shunt capacitance ensures a uniform current flow in the conductors EL which is independent of the operating conditions of the servomotors SM; this is important for the conductor-break supervision.

The closed-loop system RS, provided separately for each conductor EL, consists of a differential amplifier DV with two following threshold switches S1, S2 which cause the associated servomotor SM to run forward or backward. The threshold switch responsible for backward running, S2, is preceded by an inverter I.

The input voltages for the differential amplifier DV are derived by half-wave peak rectification of the alternating voltage at two points P1, P2 of the associated conductor EL1: one of these points is located immediately in front of the terminating resistor R1.

Figure 4:
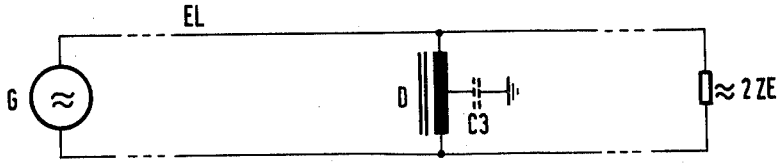
FIG. 4 shows an automatic balancing loop with a choke.
Figure 5:
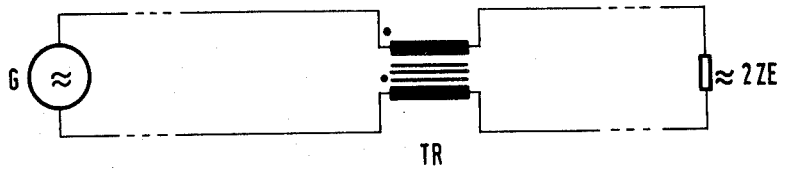
FIG. 5 shows an automatic balancing loop with a transformer.

Another embodiment is used in the closed-loop system RS of FIG. 3 for controlling a relay chain (not shown) which connects or disconnects fixed component resistances shunted across a terminating resistance. In this case, the threshold switches S1, S2 are of multistage design. Automatic balancing of the standing waves still occurring to a small degree because of the only approximate matching of the terminating resistors R1, R2 to the characteristic impedances is achieved by inductive circuit means (D, TR) as shown in FIGS. 4 and 5. In principle, the automatic balancing may also be performed independently of a control of the terminating resistor if the standing waves are not too strong. It may also be advantageous to carry out the automatic balancing simultaneously at several points, e.g. in front of and behind switches.

In FIG. 4, a tapped choke D is connected between the two conductors EL, and its center tap is connected to rail potential either directly or via a capacitor C3. The balance is achieved by means of the voltage.

In FIG. 5, the balance is achieved by means of the current. To do this, use is made of a transformer TR whose like windings are traversed by the track conductor currents in push-pull in the symmetrical case. In this case, the inductances of the windings have almost no effect because of the compensation of the total excitation in the core, while common-mode components of the current are opposed by the full inductance of the windings.

I claim:

1. Apparatus for protecting data communication between vehicles and track conductor loops in a continuous automatic train control system comprising:
   - track conductor loop means;
   - automatically controlled resistor means for terminating said track conductor loop means; and
   - closed loop control means having as a command variable the electrical current or potential difference existing between two points on said track conductor loop means as a result of the occurrence of a standing wave.

2. Apparatus in accordance with claim 1 wherein said track conductor loop means includes two conductors and wherein said two conductors are terminated by said automatically controlled resistor means.

3. Apparatus according to claim 2 further comprising means for controlling said resistors and wherein said closed loop control means and said means for controlling said resistors have coupled thereto direct current by both of said conductors such that said conductors are loaded uniformly, and such that the track is used for the return of current.

4. An arrangement according to claim 3 further comprising:
   - high-inductance choke means for feeding in and extracting the direct current at the beginning and at the end of said track conductor loop means and wherein the direct current flowing through the conductor is monitored.

5. Apparatus according to claim 2 further comprising for each conductor:
   - an electromechanically adjustable terminating resistor and wherein the control of said terminating resistor includes differential amplifier means and threshold switch means which causes the value of said terminating resistor to be increased or decreased when the output voltage of said differential amplifier exceeds or falls below a predetermined voltage range, and that a voltage proportional to the voltage caused by a standing wave between said two points of said conductor located a certain distance apart is applied to the inputs of said differential amplifier, said two points being selected to maximize the voltage caused by the standing wave between said two points.

6. Apparatus according to claim 5 wherein said terminating resistor comprises a plurality of fixed resistors and wherein the effective terminating resistance is automatically adjusted to the value coming closest to the characteristic impedance, and that, with a termination consisting of one or more fixed terminating resistors, standing waves still occurring on the two conductors of a track conductor loop to a small degree are automatically balanced by inductive elements which are arranged at those points of the track conductor loops where the electrical variable used for balancing has a maximum value or difference between the conductors.

7. Apparatus in accordance with claim 6 wherein said electrical variable used for balancing is the voltage of said standing wave.

8. Apparatus according to claim 7 wherein one or more of said fixed resistors are connected in parallel.

9. Apparatus according to claim 7 wherein one or more of said fixed resistors are connected in series.

10. Apparatus according to claim 6 wherein the electrical variable used for balancing is the current of said standing wave.

11. Apparatus according to claim 10 wherein one or more of said fixed resistors are connected in parallel.

12. Apparatus according to claim 10 wherein one or more of said fixed resistors are connected in series.

13. Apparatus according to claim 6, wherein said inductive elements are center-tapped chokes connected between said two conductors and having their taps connected to rail potential.

14. Apparatus according to claim 13 wherein said taps are capacitively connected to said rail potential.

15. An arrangement according to claim 6, wherein said inductive elements are transformers with two like windings which are traversed by the currents of said two conductors in push-pull.

* * * * *